US011324364B2

(12) United States Patent
Singh

(10) Patent No.: US 11,324,364 B2
(45) Date of Patent: May 10, 2022

(54) REMOTE CONTROLLED TOILET SEAT LIFT SYSTEM AND METHODS OF USE

(71) Applicant: Parminder Singh, Alpharetta, GA (US)

(72) Inventor: Parminder Singh, Alpharetta, GA (US)

( * ) Notice: Subject to any disclaimer, the term of this patent is extended or adjusted under 35 U.S.C. 154(b) by 0 days.

(21) Appl. No.: 17/235,716

(22) Filed: Apr. 20, 2021

(65) Prior Publication Data

US 2021/0321839 A1 Oct. 21, 2021

Related U.S. Application Data

(60) Provisional application No. 63/012,853, filed on Apr. 20, 2020.

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1
See application file for complete search history.

(56) References Cited

U.S. PATENT DOCUMENTS 5,794,277 A 8/1998 Jones
5,829,067 A * 11/1998 Smith ..... A47K 13/10 4/246.1
6,067,667 A 5/2000 Suzuki
6,226,804 B1 5/2001 Ballard
6,230,336 B1 5/2001 Knoll et al.
6,792,626 B1 9/2004 Smeal et al.
7,334,271 B2 2/2008 Jung
7,636,956 B1 12/2009 Doucet
7,917,973 B2 4/2011 Baumoel
8,272,081 B2 * 9/2012 Anderson, Jr. ..... A61G 5/14 4/667
8,336,126 B2 12/2012 Baumoel
2006/0005309 A1 1/2006 Aurora
2007/0056085 A1 3/2007 Dyson et al.
2009/0106885 A1 4/2009 Sagre
2009/0193570 A1 8/2009 Tong et al.
2010/0083431 A1 4/2010 Hallett
2021/0307571 A1 * 10/2021 Chung ..... A47K 13/10

* cited by examiner

*Primary Examiner* — Christine J Skubinna
(74) *Attorney, Agent, or Firm* — Mathew L. Grell; Grell & Watson Patent Attorneys LLC

(57) ABSTRACT

A remote controlled toilet seat lift system and methods of use having a housing having one or more angled clamps configured to attach the housing to the rim of the bowl, a lift mechanism positioned therein the lift housing, the lift mechanism having a battery electrically connected to dual direction drive, the dual direction drive connected to a toothed gear, the toothed gear in rotational contact with a toothed arcing lift arm to engage the toothed gear, the toothed arcing lift arm slidably affixed to the lift housing to traverse a curved path and having a first end with an aperture, the an toothed arcing lift arm extendable therefrom the housing, a lift pin affixed therein the aperture, the lift pin in contact with the toilet seat and, thus, functions to provide sanitary non-hand contact raising and lowering of the toilet seat and lid.

11 Claims, 7 Drawing Sheets

REMOTE CONTROLLED TOILET SEAT LIFT SYSTEM AND METHODS OF USE

CROSS-REFERENCE TO RELATED APPLICATIONS

To the full extent permitted by law, the present United States Non-provisional patent application hereby claims priority to and the full benefit of, U.S. Provisional Application No. 63/012,853, filed on Apr. 20, 2020, entitled "Remote Controlled Toilet Seat Lift System and Methods of Use", which is incorporated by reference herein in its entirety.

FIELD OF THE DISCLOSURE

The present disclosure is directed to a subsystem for a toilet. More specifically, the present disclosure is directed to an automatically controlled toilet seat raise and lower mechanism.

BACKGROUND

The first step of using a shared or public toilet bowl is to decide whether to move the toilet seat and lid to the up or down position. We are all concerned with germs and diseases that may be lingering on the toilet seat and lid from a prior user and therefore we are reluctant to touch the toilet seat and lid.

One prior approach of a toilet seat lift system is to use your shoe to catch the edge of the toilet seat and lid and raise them to the up position while lifting your leg. One disadvantage or drawback to this approach is that one may slip and fall while standing on one leg, especially if the bathroom floor is wet or dirty.

Another approach is to affix a handle to the toilet seat or lid side edge and the handle is used by a user to lift toilet seat and lid instead of touching the seat itself. One disadvantage or drawback to this approach is that user must still lift and lower the seat manually with the handles—and possibly contaminate their hands.

Another approach is to integrate a foot-actuated mechanical lift. One disadvantage or drawback to this approach is that these lifts often require modifications to the toilet and sometimes require the user to keep their foot on a pedal during urination.

Other prior approaches or devices have been suggested to avoid hands touching toilet seats shared by others of different nature in maintaining toilet sanitation. Such devices include motorized lifting devices connected to a straight rod toilet seat lift mechanism. One disadvantage or drawback to this approach is that straight rod lift systems can bind when lifting a hinged toilet seat and lid traveling in an arc. Another disadvantage or drawback to this approach is that they may require modifications to the toilet seat hinge mechanism or requires the user to purchase a new seat with the hinge mechanism already installed. is that straight rod lift systems can bind when lifting a hinged toilet seat and lid traveling in an arc. Another disadvantage or drawback to this approach is that if the motorized lifting devices are floor mounted adjustments for toilets of different heights may be required.

Therefore, it is readily apparent that there is a recognizable unmet need for a remote controlled toilet seat lift system and methods of use that may be configured to address at least some aspects of the problems discussed above common to automatic raising and lowering hinged toilet seat and/or lid.

SUMMARY

Briefly described, in an example embodiment, the present disclosure may overcome the above-mentioned disadvantages and may meet the recognized need for a remote controlled toilet seat lift system and methods of use having a housing having one or more angled clamps configured to attach the housing to the rim of the bowl, a lift mechanism positioned therein the lift housing, the lift mechanism having a battery electrically connected to dual direction drive, the dual direction drive connected to a toothed gear, the toothed gear in rotational contact with an toothed arcing lift arm to engage the toothed gear, the toothed arcing lift arm slidably affixed to the lift housing and having a first end with an aperture, the an toothed arcing lift arm extendable therefrom the housing, a lift pin affixed therein the aperture, the lift pin in contact with a front underside of the toilet seat and, thus, functions to provide sanitary non-hand contact raising and lowering of the toilet seat and lid.

Accordingly, in another aspect, the present disclosure of a wireless remote controller, the controller having a switch assembly electrically connected between the battery and the dual direction drive, and a handheld fob with an up button and a down button to raise and lower the toothed pulley, toothed arcing lift arm, and the lift pin connected to the toilet seat and lid.

In an exemplary embodiment of a toilet seat lift system for a toilet having a toilet bowl rim and a toilet seat hinged thereto and traverses between a raised position and lowered position, said system including, a housing having a backside, a top side and a bottom side, said top side having an upper aperture and said bottom side having a lower aperture, said housing having bracket assembly configured to attach said housing to the toilet bowl rim, an arced lift arm having a first arm end and a second arm end, said arced lift arm having a plurality of gear teeth formed on one side from proximate said first arm end to said second arm end, said second arm end having a toilet seat lever to engage the toilet seat, an arm guide affixed to said backside, said arm guide configured to control upward movement of said arced lift arm through said upper aperture in a curved trajectory to the raised position and control downward movement of said arced lift arm through said lower aperture in said curved trajectory to the lowered position, a motor affixed to said backside, said motor having a toothed drive gear to rotationally engage said plurality of gear teeth, a battery electrically connected to said motor, and a motor controller electrically connected to said motor, said motor controller to control a rotational direction of said toothed drive gear.

In another exemplary embodiment of a method of automatically raising and lowering a toilet seat between a lowered position proximate a toilet bowl rim and a raised position, said method including the steps of providing a toilet seat lift system having a housing having a backside, a top side and a bottom side, said top side having an upper aperture and said bottom side having a lower aperture, said housing having bracket assembly configured to attach said housing to the toilet bowl rim, an arced lift arm having a first arm end and a second arm end, said arced lift arm having a plurality of gear teeth formed on one side from proximate said first arm end to said second arm end, said second arm end having a toilet seat lever to engage the toilet seat, an arm guide affixed to said backside, said arm guide configured to control upward movement of said arced lift arm through said upper aperture in a curved trajectory to the raised position and control downward movement of said arced lift arm through said lower aperture in said curved trajectory to the lowered position, a motor affixed to said backside, said motor having a toothed drive gear to rotationally engage said plurality of gear teeth, a battery electrically connected to said motor, and a motor controller electrically connected to said motor, said motor controller to control a rotational direction of said toothed drive gear, attaching said bracket assembly of said housing to the toilet bowl rim; and attaching said toilet seat lever to the toilet seat.

A feature of the present disclosure may include enabling hands free lid movement for sanitary and convenience or other purposes to reduce the chances of infections to human beings at significant levels.

A feature of the present disclosure may include providing a toothed arcing lift arm rather than a straight rod lift systems, which can bind when lifting a hinged toilet seat and lid traveling in an arc.

A feature of the present disclosure may include a rim mounted housing rather than a floor mounted housing, which may require adjustments for toilets of different heights.

A feature of the present disclosure may include no requirement to power the apparatus by electricity limiting their use to locations with a power source.

A feature of the present disclosure may include a self-contained power system rather than foot powered, which may require the user to keep their foot on a pedal during urination.

A feature of the present disclosure may include no requirement to modify the toilet, toilet lids or hinge system.

A feature of the present disclosure may include saving of natural resources (water and tree paper) by decreasing the use of papers, water and paper cleaning products used for lid contact during movement.

A feature of the present disclosure may include a reduction in the cost of labor and save money to replace toilet seats from drop/banging and tree paper by decreasing the use of paper cleaning products used for lid contact during movement.

These and other features of the a remote controlled toilet seat lift system and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present disclosure will be better understood by reading the Detailed Description of the Preferred and Selected Alternate Embodiments with reference to the accompanying drawing Figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in the figures specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
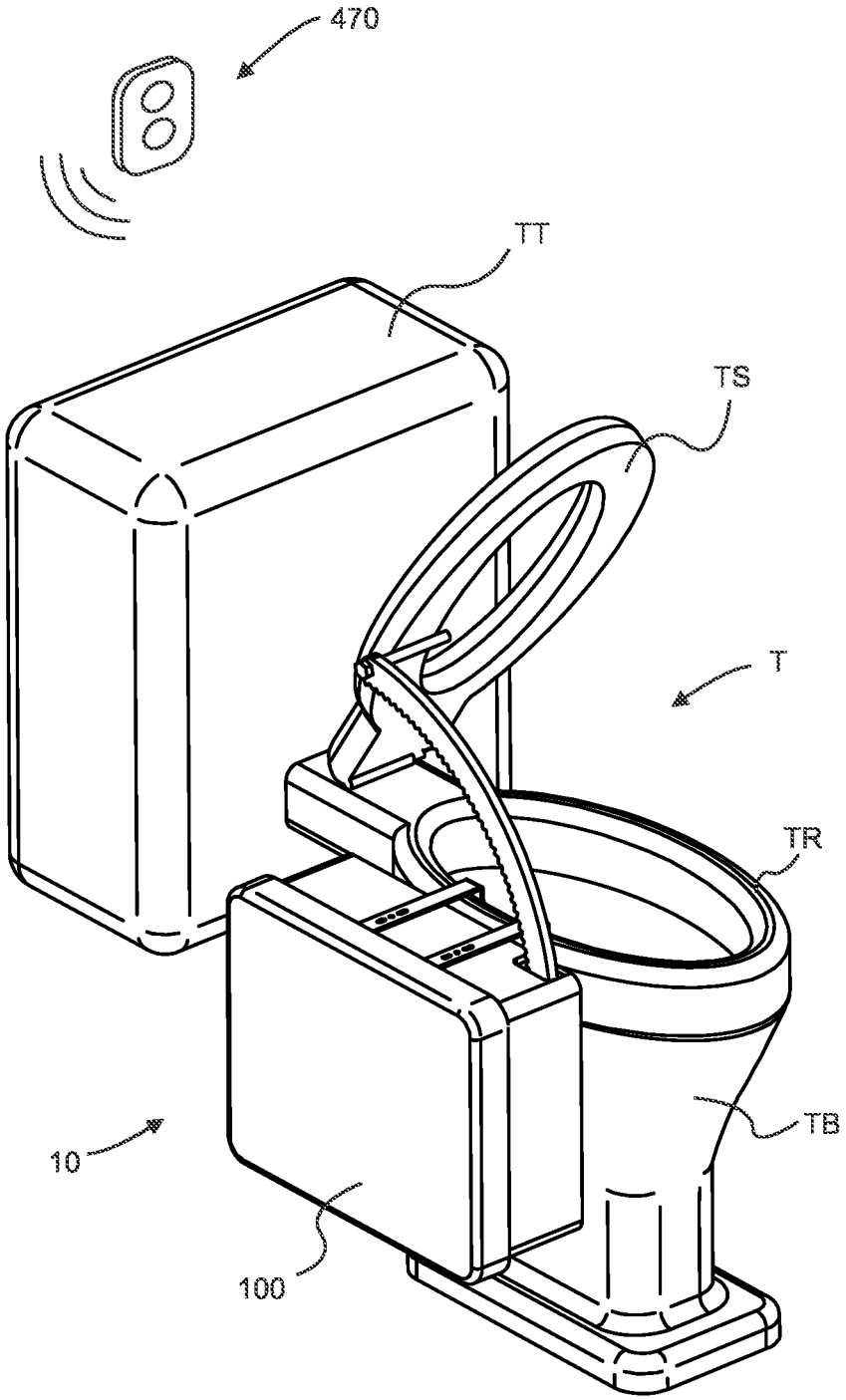
FIG. 1 is a side perspective view of the housing of the remote controlled toilet seat lift system according to select embodiments of the instant disclosure, shown attached to the toilet bowl rim.

Referring now to FIG. 1, by way of example, and not limitation, there is illustrated an example embodiment of the remote controlled toilet seat lift system 10 shown affixed to a toilet bowl rim, according to this select embodiment. A standard toilet T may include the following components, such as toilet bowl TB having a toilet rim TR, a hinged lid(s), such as toilet seat TS may hinge from the backside of toilet rim TR, and toilet tank TT may be affixed to backside of toilet rim TR and positioned vertically above toilet bowl and in fluid communication with the toilet bowl TB. Toilet remote controlled toilet seat lift system 10 may include a container, such as housing 100 to form a water proof barrier for internal components of remote controlled toilet seat lift system 10.

It is contemplated herein that toilet remote controlled toilet seat lift system 10 may be attached or removeably attached to toilet T, toilet bowl TB, toilet bowl rim TR, toilet tank TT, or any hardware securing the toilet to a floor or wall.

Figure 2:
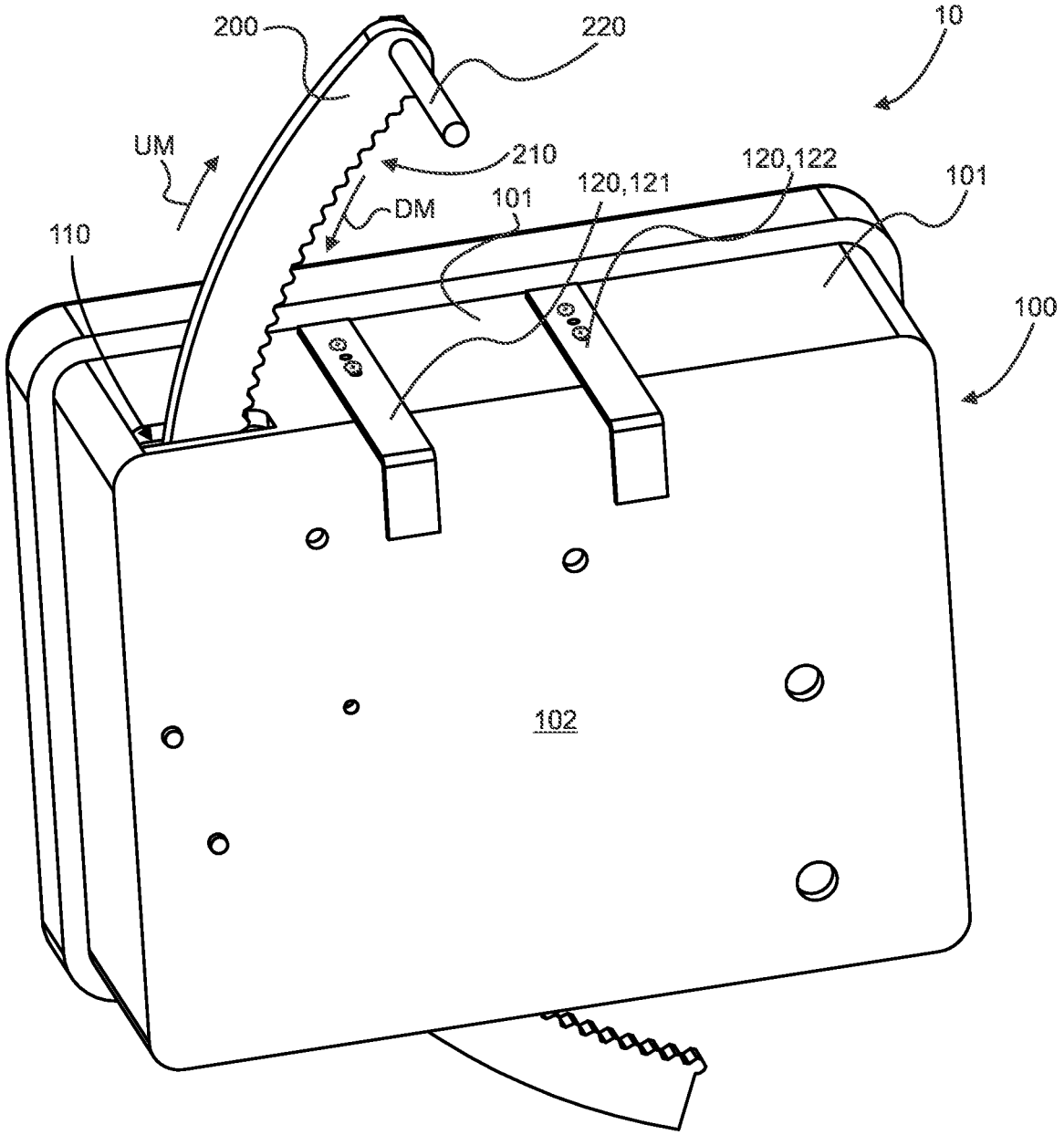
FIG. 2 is a top side perspective view of the remote controlled toilet seat lift system according to select embodiments of the instant disclosure.

Referring now to FIG. 2, by way of example, and not limitation, there is illustrated an example embodiment of the remote controlled toilet seat lift system 10. Remote controlled toilet seat lift system 10 may include housing 100 having one or more sides or walls, such as top side 101 and backside 102. Moreover, housing 100 may be configured in any shape or dimension capable of supporting and housing remote controlled toilet seat lift system 10 or color to make it attractive for marketing purposes. Top side 101 may include one or more holes, such as upper aperture 110 positioned in top side 101 and lower aperture 112 positioned in bottom side 103 to enable a toilet seat lift arm to extend therethrough in an upward movement UM and a downward movement DM. One or more sides, such as top side 101, backside 102, and bottom side 103 may include one or more attachment devices, such as bracket assembly 120 affixed or removeably affixed thereto one or more sides, such as top side 101 or backside 102 and configured to attach or removeably attach or hang housing 100 to toilet T, toilet bowl TB, toilet bowl rim TR, toilet tank TT, or any hardware securing the toilet to a floor or wall and more specifically to toilet rim TR. Bracket assembly 120 may include first toilet bracket 121 and second toilet bracket 122 positioned in a spaced apart configuration to distribute the weight of housing 100 across each toilet bracket assembly 120. Furthermore, one or more bracket assemblies may be adjustable according to adjust bracket assembly 120 to fit the size and shape of toilet bowl rim TR, and may have a locking or clamping feature in order to hold or secure housing 100 strongly and securely to toilet bowl rim TR.

It is contemplated herein that housing 100 may include a lid access 104 to create a tight seal for housing 100, however, other mating surfaces are contemplated herein.

It is further contemplated herein that housing 100 and bracket assembly 120 may be constructed of plastic, stainless steel, aluminum, or the like materials and of different dimensions. This and other materials herein may be constructed of metal, steel, alloy, or plastic or more specifically high density polyethylene or similar high tensile or strengthened materials, as these material offers a variety of forms and shapes and provide strength with reduced weight; however, other suitable materials or the like, can be utilized, provided such material has sufficient strength and/or durability as would meet the purpose described herein.

Figure 3A:
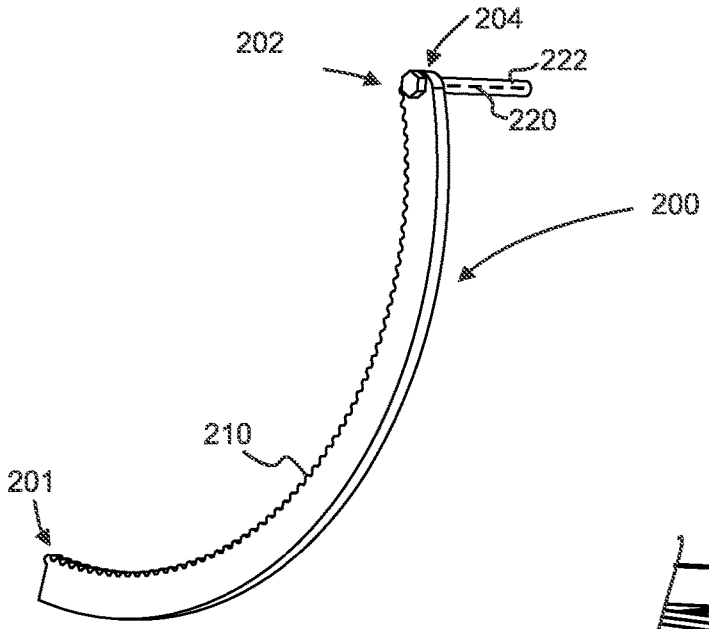
FIG. 3A is a side view of the arced lift arm of the remote controlled toilet seat lift system according to select embodiments of the instant disclosure.

Referring now to FIG. 3A by way of example, and not limitation, there is illustrated an example embodiment of the remote controlled toilet seat lift system 10. Remote controlled toilet seat lift system 10 may include a toilet seat lift arm, such as curved, semi-circle toilet seat lift arm, such as arced lift arm 200. Arced lift arm 200 may be configured having first arm end 201 and second arm end 202 and formed having a plurality of gear teeth 210 formed on one side and running linearly the length of arced lift arm 200 from proximate first arm end 201 to proximate second arm end 202 for engaging a toothed drive gear. Second arm end 202 may be configured with a hole or pin aperture 204 to receive therethrough a lift pin 220 positioned perpendicular to second arm end 202 to catch to engage the toilet seat TS, such as toilet seat lever 220 positioned perpendicular to upward movement UM and a downward movement DM of arced lift arm 200. Toilet seat lever 220 may include a protective shield, such as cover 222 to surround toilet seat lever 220 and protect toilet seat from friction rubbing of toilet seat lever 220 when toilet seat lever 220 engages the underside of toilet seat TS. Moreover, cover 222 reduces noise when toilet seat lever 220 engages the underside of toilet seat TS.

It is contemplated herein that arced lift arm 200 length may be long enough to lift the toilet seat TS up to proximately 90-degree angle relative to toilet bowl rim TR.

Figure 3B:
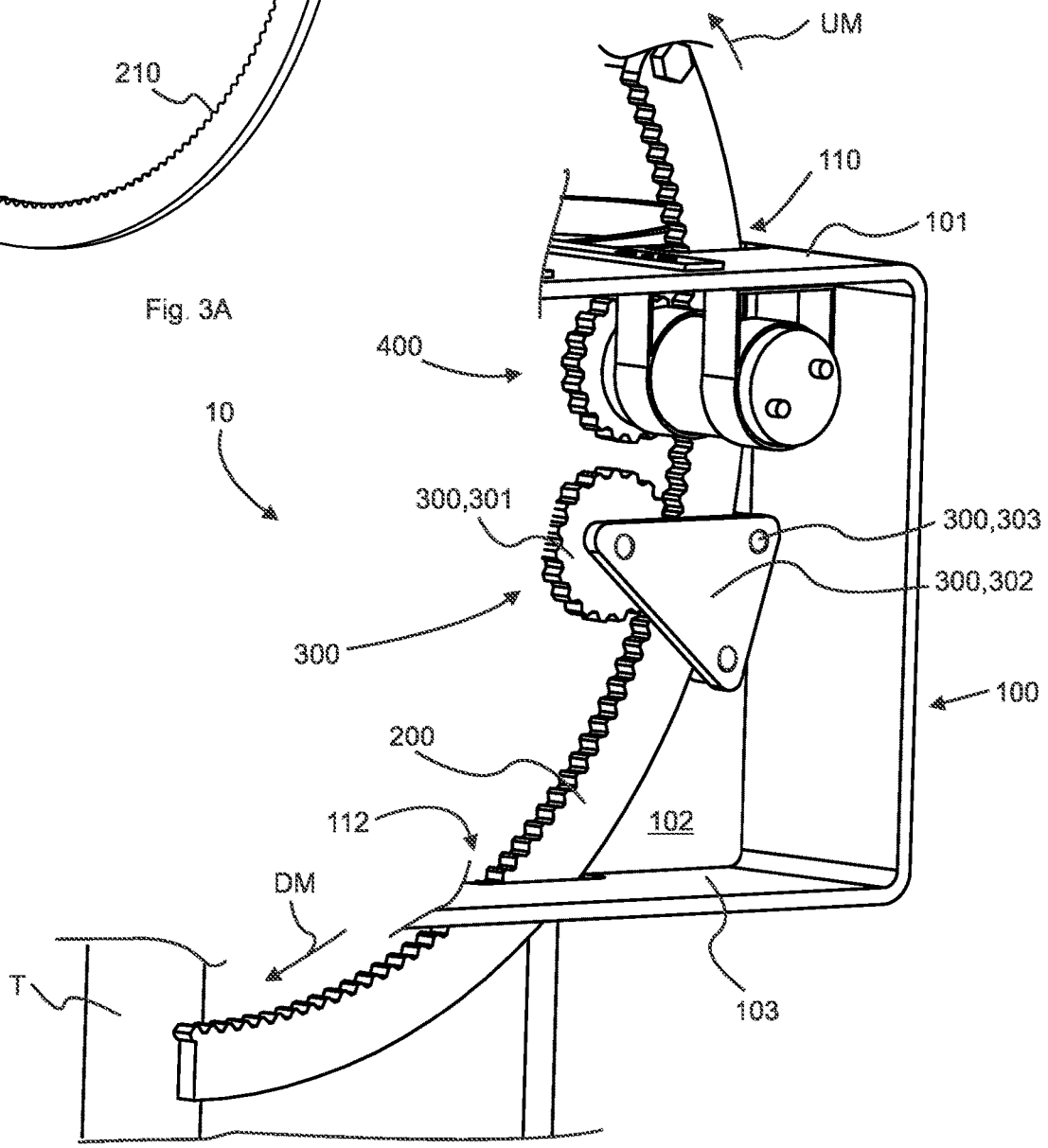
FIG. 3B is a side perspective view of the housing of the remote controlled toilet seat lift system according to select embodiments of the instant disclosure, shown with arced lift arm attached to a wall via arm guide.

Referring now to FIG. 3B by way of example, and not limitation, there is illustrated an example embodiment of a cross section of housing 100 of remote controlled toilet seat lift system 10. Preferably, backside 102 of housing 100 may have affixed thereto or include one or more channels or rollers, such as arm guide 300 to control and contain arced lift arm 200 in a curved trajectory as an upward movement UM and a downward movement DM of arced lift arm 200, where arced lift arm 200 traverses in an arc path through upper aperture 110 positioned in top side 101 during curved trajectory in upward movement UM of arced lift arm 200 and in reverse traverses through lower aperture 112 positioned in bottom side 103 during curved trajectory in downward movement DM of arced lift arm 200. Arm guide 300 may include roller gear 301, guide cover 302, and bolt 303 connected together to form guide 300 to control and contain upward movement UM and a downward movement DM of arced lift arm 200. Arm guide 300 preferably functions to maintain lift arm 200 in an arced or curved trajectory during operation, to raise or lower lift arm 200 in and in conjunction raise and lower toilet seat TS.

It is contemplated herein that arm guide 300 may be configured to enable lift arm 200 to slide therein.

It is contemplated herein that arced lift arm 200 and arm guide 300 may be constructed of plastic, stainless steel, aluminum, or the like materials and of different dimensions. This and other materials herein may be constructed of metal, steel, alloy, or plastic or more specifically high density polyethylene or similar high tensile or strengthened materials, as these material offers a variety of forms and shapes and provide strength with reduced weight; however, other suitable materials or the like, can be utilized, provided such material has sufficient strength and/or durability as would meet the purpose described herein.

Figure 4A:
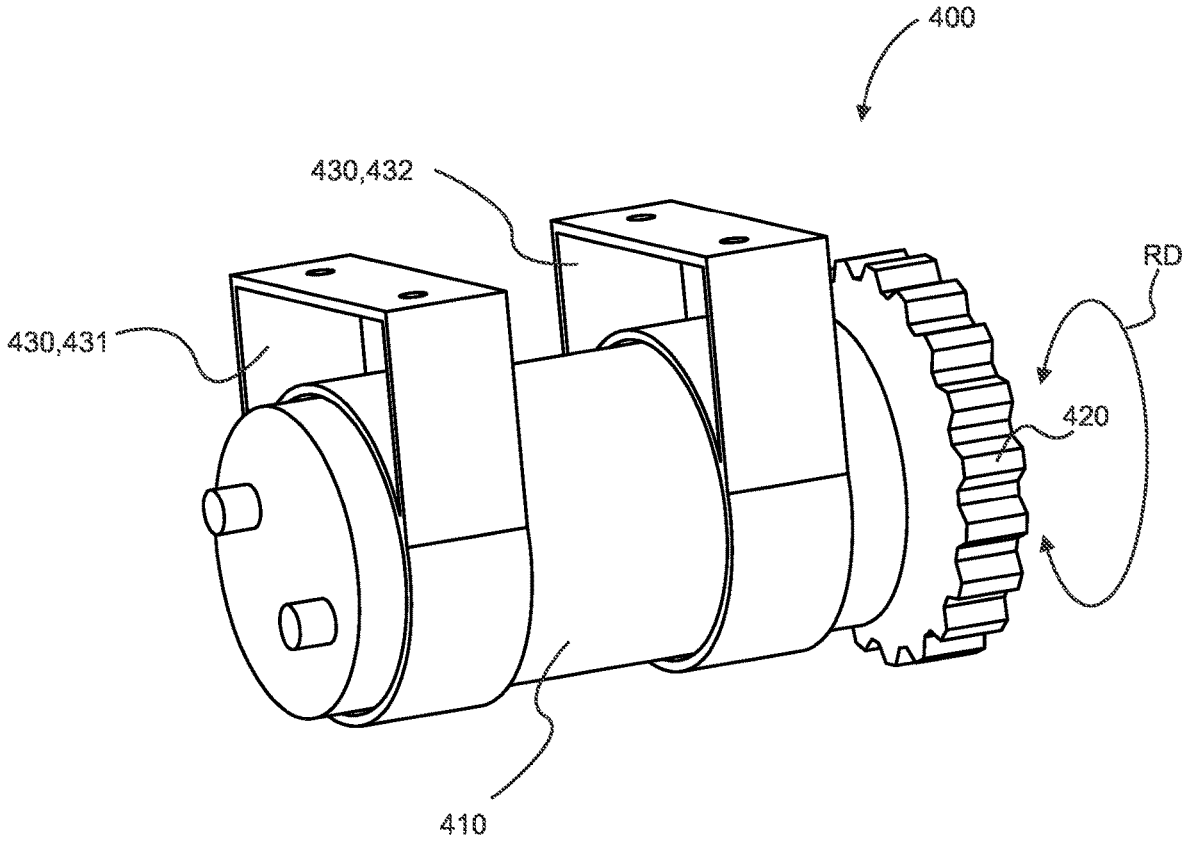
FIG. 4A is a side perspective view of the drive motor and gear of the remote controlled toilet seat lift system according to select embodiments of the instant disclosure.

Referring now to FIG. 4A by way of example, and not limitation, there is illustrated an example embodiment of a drive mechanism, such as motor with toothed gear 400 of remote controlled toilet seat lift system 10. Preferably, motor with toothed gear 400 may include a drive mechanism, such as motor 410 and toothed drive gear 420. Toothed drive gear 420 may be configured to rotationally engage (bi-directional rotational direction RD) plurality of gear teeth 210 of arced lift arm 200 to drive arced lift arm 200 depending upon the rotating direction of motor 410, where first rotational direction RD of toothed drive gear 420 drives or raises arced lift arm 200 to traverse in an arc path through upper aperture 110 positioned on top side 101 during upward movement UM of arced lift arm 200 and in reverse second rotational direction RD of toothed drive gear 420 drives or lowers arced lift arm 200 to reverse in an arc path traverse through lower aperture 112 positioned in bottom side 103 during downward movement DM of arced lift arm 200.

One or more attachment devices, such as motor bracket assembly 430 may include first motor bracket 431 and second motor bracket 432 positioned in a spaced apart configuration to distribute the weight of motor with toothed gear 400 across each motor bracket assembly 430. Furthermore, one or more motor bracket assemblies may be adjustable according to adjust motor bracket assembly 430 to mount, position, and affix motor with toothed gear 400 to housing 100.

It is contemplated herein that gear ratios of toothed drive gear 420 and gear teeth 210 of arced lift arm 200 are calculated to lift the toilet seat TS up to proximately 90-degree angle relative to toilet bowl rim TR.

Figure 4B:
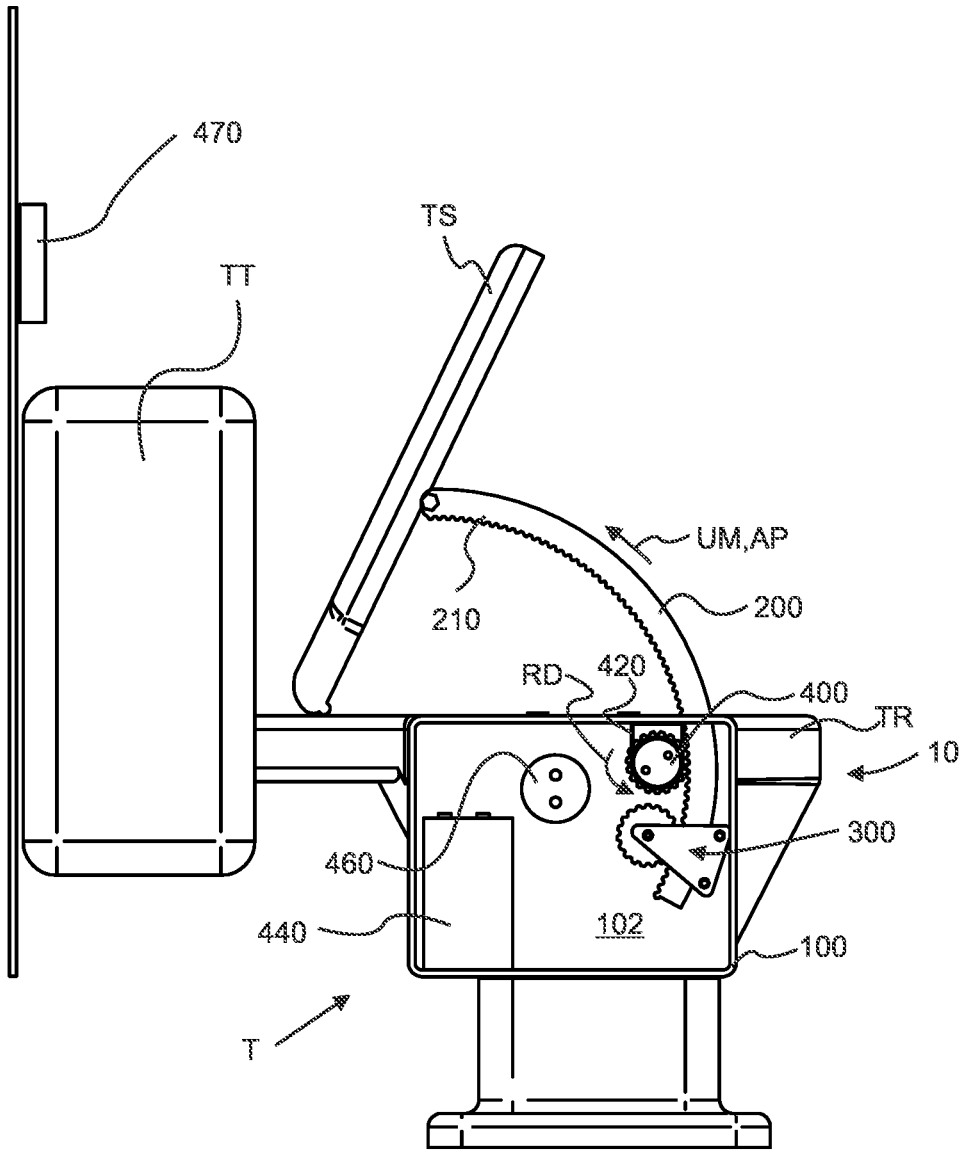
FIG. 4B is a side perspective view of the housing of the remote controlled toilet seat lift system according to select embodiments of the instant disclosure, shown with arced lift arm attached to a wall in an raised position via arm guide and drive motor, battery and control circuit.

Referring now to FIG. 4B by way of example, and not limitation, there is illustrated an example embodiment of a cross section of housing 100 of remote controlled toilet seat lift system 10. Preferably, backside 102 of housing 100 may have affixed thereto or include arced lift arm 200, arm guide 300, motor with toothed gear 400 may be mechanically connected therebetween toothed drive gear 420 and gear teeth 210 of arced lift arm 200, where first rotational direction RD of toothed drive gear 420 drives or raises arced lift arm 200 to traverse in an arc path AP through upper aperture 110 positioned on top side 101 during upward movement UM of arced lift arm 200.

Figure 4C:
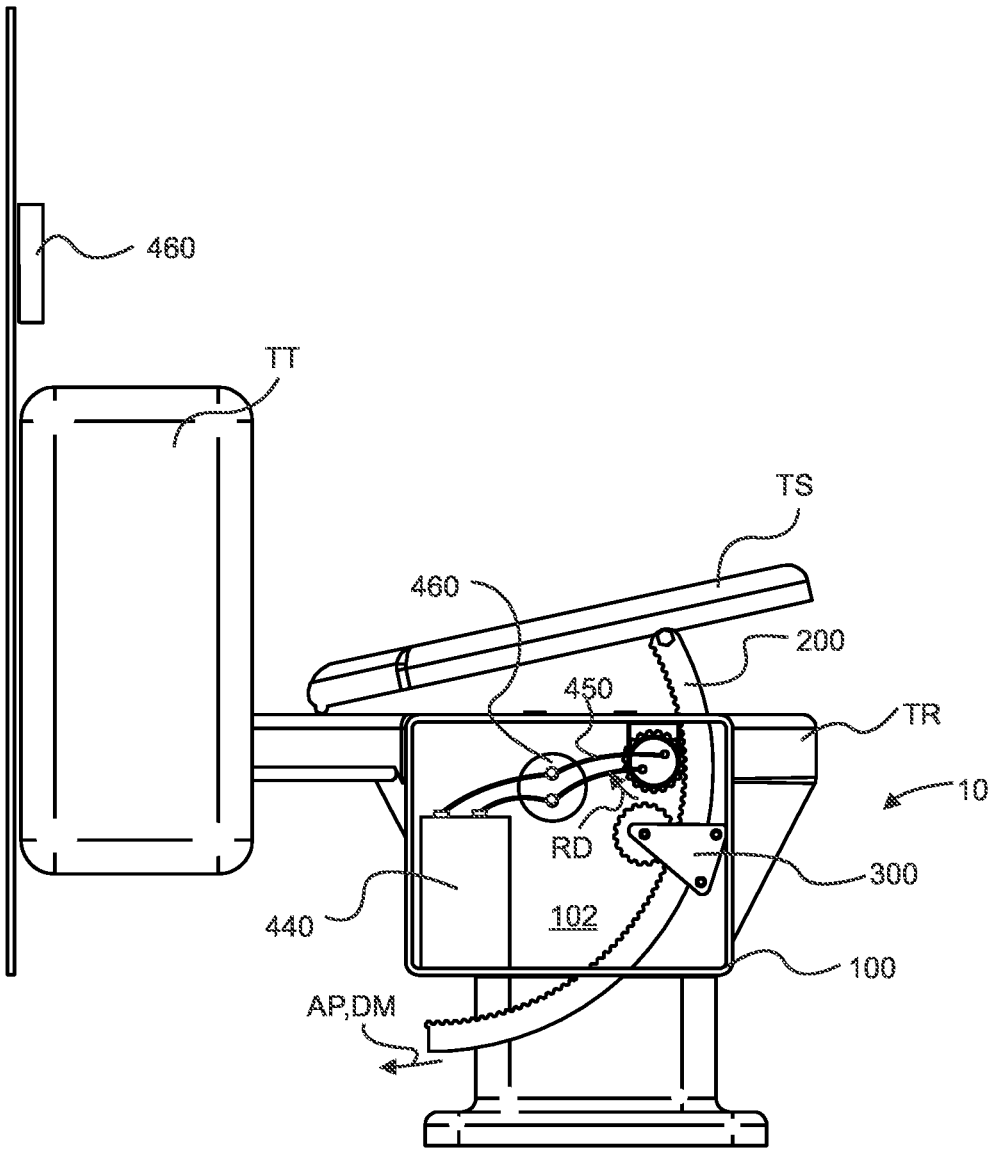
FIG. 4C is a side perspective view of the housing of the remote controlled toilet seat lift system according to select embodiments of the instant disclosure, shown with arced lift arm attached to a wall in an lowered position via arm guide and drive motor, battery and control circuit.

Referring now to FIG. 4C by way of example, and not limitation, there is illustrated an example embodiment of a cross section of housing 100 of remote controlled toilet seat lift system 10. Preferably, backside 102 of housing 100 may have affixed thereto or include arced lift arm 200, arm guide 300, motor with toothed gear 400 may be mechanically connected therebetween toothed drive gear 420 and gear teeth 210 of arced lift arm 200, where in reverse second rotational direction RD of toothed drive gear 420 drives or lowers arced lift arm 200 to reverse in an arc path AP traverse through lower aperture 112 positioned in bottom side 103 during downward movement DM of arced lift arm 200 relative to housing 100.

It is contemplated herein FIGS. 4B and 4C that motor 410 may be a DC motor and be electrically connected 450 via wires or circuit board to a power supply, such as battery 440 and further electrically connected 450 to a motor controller 460, such as remote control circuit 460. Remote control circuit 460 may enable wired or wireless remote control of motor 410 to enable, control, or initiate first rotational direction RD of toothed drive gear 420 drives or raises arced lift arm 200 to traverse in an arc path through upper aperture 110 positioned on top side 101 during upward movement UM of arced lift arm 200 to lift the toilet seat TS up to proximately 90-degree angle relative to toilet bowl rim TR and in reverse second rotational direction RD of toothed drive gear 420 drives or lowers arced lift arm 200 to reverse in an arc path traverse through lower aperture 112 positioned in bottom side 103 during downward movement DM of arced lift arm 200 to lower the toilet seat TS to be in contact with toilet bowl rim TR.

It is contemplated herein that battery may be rechargeable battery.

Moreover, in use a remote switch 470 with UP and Down controls (to activate or control motor controller 460) may be wired or wireless connected to motor controller 460 to direct remote control circuit 460 and motor 410 to enable, control, or initiate first rotational direction RD of toothed drive gear 420 drives or raises arced lift arm 200 to traverse in an arc path through upper aperture 110 positioned on top side 101 during upward movement UM of arced lift arm 200 to lift the toilet seat TS up to proximately 90-degree angle relative to toilet bowl rim TR (raised position) and in reverse second rotational direction RD of toothed drive gear 420 drives or lowers arced lift arm 200 to reverse in an arc path traverse through lower aperture 112 positioned in bottom side 103 during downward movement DM of arced lift arm 200 to lower the toilet seat TS to be in contact with toilet bowl rim TR (lowered position).

It is contemplated herein that remote switch 500 may include motion sensors, sound sensor, or a smart device in communication with motor controller 460 to detect a user and automatically direct remote control circuit 460 and motor 410 to enable, control, or initiate first rotational direction RD of toothed drive gear 420 drives or raises arced lift arm 200 to traverse in an arc path through upper aperture 110 positioned on top side 101 during upward movement UM of arced lift arm 200 to lift the toilet seat TS up to proximately 90-degree angle relative to toilet bowl rim TR and in reverse second rotational direction RD of toothed drive gear 420 drives or lowers arced lift arm 200 to reverse in an arc path traverse through lower aperture 112 positioned in bottom side 103 during downward movement DM of arced lift arm 200 to lower the toilet seat TS to be in contact with toilet bowl rim TR.

It is recognized herein that power supply, such as battery 440 may include a variety of power sources, such as AC or may enable charging of detachable batteries.

It is understood herein that various changes in the material used, shape, size, arrangement of parts, and parts are removeably connected with threads, or other rotating devices without departing from the spirit of the scope of the claims herein.

It is further understood herein that the parts and elements of this disclosure may be located or position elsewhere based on one of ordinary skill in the art without deviating from the present disclosure.

Figure 5:
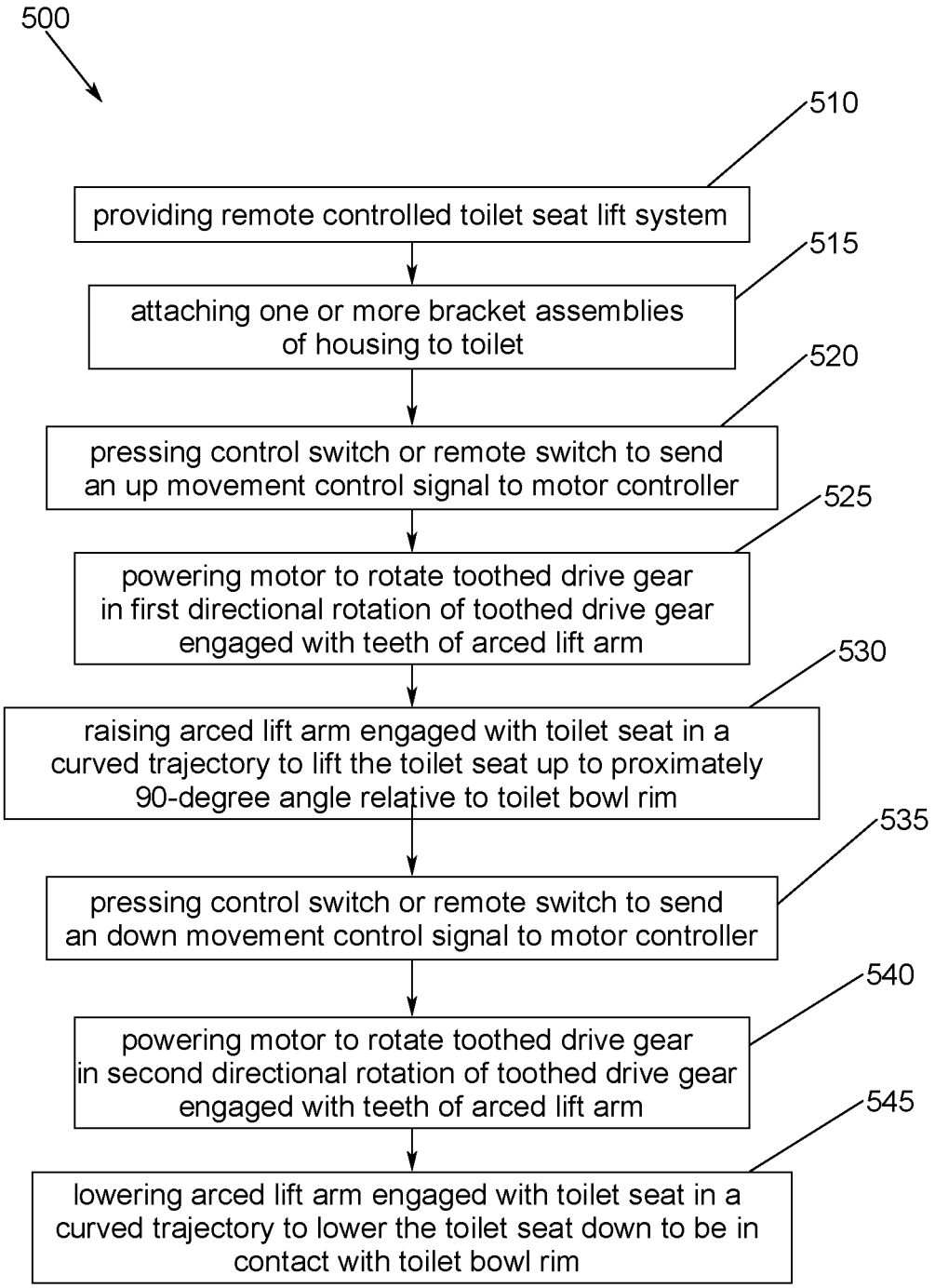
FIG. 5 is a flow diagram depicting assembly and operation of remote controlled toilet seat lift system.

Referring now to FIG. 5, there is illustrated a flow diagram 500 of a method of assembly and operation of remote controlled toilet seat lift system 10 (method of automatically raising and lowering toilet seat TS between a lowered position proximate a toilet bowl rim and a raised position proximate 90 degrees or near toilet tank TT). In block or step 510, providing remote controlled toilet seat lift system 10, as described above in FIGS. 1-4. In block or step 515, attaching bracket assembly 120 of housing 100 to toilet T, toilet bowl TB, toilet bowl rim TR, toilet tank TT, or any hardware securing the toilet to a floor or wall and more specifically to toilet rim TR and attaching In block or step 520, pressing UP control of switch or remote switch 470 to send an UP movement UM control signal to motor controller 460. In block or step 525, powering motor 410 to turn or rotate toothed drive gear 420 in first rotational direction RD of toothed drive gear 420 engaged with gear teeth 210 of arced lift arm 200. In block or step 530, raising arced lift arm 200 engaged with toilet seat TS in a curved trajectory to lift the toilet seat TS up to proximately 90-degree angle relative to toilet bowl rim TR.

In block or step 535, pressing DOWN control of switch or remote switch 470 to send a down movement DM control signal to motor controller 460. In block or step 540, powering motor 410 to turn or rotate toothed drive gear 420 in second rotational direction RD of toothed drive gear 420 engaged with gear teeth 210 of arced lift arm 200. In block or step 545, lowering arced lift arm 200 engaged with toilet seat TS in a curved trajectory to lower the toilet seat TS down to be in contact with toilet bowl rim TR.

With respect to the above description then, it is to be realized that the optimum dimensional relationships, to include variations in size, materials, shape, form, position, movement mechanisms, function and manner of operation, assembly and use, are intended to be encompassed by the present disclosure.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. A toilet seat lift system for a toilet having a toilet bowl rim and a toilet seat hinged thereto and traverses between a raised position and lowered position, said system comprising, a housing having a backside, a top side and a bottom side, said top side having an upper aperture and said bottom side having a lower aperture, said housing having bracket assembly configured to attach said housing to the toilet bowl rim;

an arced lift arm having a first arm end and a second arm end, said arced lift arm having a plurality of gear teeth formed on one side from proximate said first arm end to said second arm end, said second arm end having a toilet seat lever to engage the toilet seat;

an arm guide affixed to said backside, said arm guide configured to control upward movement of said arced lift arm through said upper aperture in a curved trajectory to the raised position and control downward movement of said arced lift arm through said lower aperture in said curved trajectory to the lowered position;

a motor affixed to said backside, said motor having a toothed drive gear to rotationally engage said plurality of gear teeth;

a battery electrically connected to said motor; and a motor controller electrically connected to said motor, said motor controller to control a rotational direction of said toothed drive gear.

2. The system of claim 1, wherein said toilet seat lever further comprises a protective shield.

3. The system of claim 1, wherein said arm guide further comprises a roller gear rotationally affixed to said backside.

4. The system of claim 1, wherein said motor further comprises a motor bracket assembly configured to attach said motor to said backside.

5. The system of claim 1, further comprising a remote switch having an up button and a down button, said remote switch in wireless communication with said motor controller to activate said motor controller.

6. The system of claim 1, wherein said battery further comprises a rechargeable battery.

7. The system of claim 1, wherein a first rotational direction of said toothed drive gear raises said arced lift arm in an arc path through said upper aperture to lift the toilet seat to the raised position.

8. The system of claim 7, wherein a second rotational direction of said toothed drive gear lowers said arced lift arm in an arc path through said lower aperture to lower the toilet seat to the lowered position.

9. A method of automatically raising and lowering a toilet seat between a lowered position proximate a toilet bowl rim and a raised position, said method comprising the steps of:

providing a toilet seat lift system having a housing having a backside, a top side and a bottom side, said top side having an upper aperture and said bottom side having a lower aperture, said housing having bracket assembly configured to attach said housing to the toilet bowl rim, an arced lift arm having a first arm end and a second arm end, said arced lift arm having a plurality of gear teeth formed on one side from proximate said first arm end to said second arm end, said second arm end having a toilet seat lever to engage the toilet seat, an arm guide affixed to said backside, said arm guide configured to control upward movement of said arced lift arm through said upper aperture in a curved trajectory to the raised position and control downward movement of said arced lift arm through said lower aperture in said curved trajectory to the lowered position, a motor affixed to said backside, said motor having a toothed drive gear to rotationally engage said plurality of gear teeth, a battery electrically connected to said motor, and a motor controller electrically connected to said motor, said motor controller to control a rotational direction of said toothed drive gear;

attaching said bracket assembly of said housing to the toilet bowl rim; and attaching said toilet seat lever to the toilet seat.

10. The method of claim 9, further comprising the step of rotating said toothed drive gear in a first rotational direction raises said arced lift arm in an arc path through said upper aperture to lift the toilet seat to the raised position.

11. The method of claim 10, further comprising the step of rotating said toothed drive gear in a second rotational direction lowers said arced lift arm in an arc path through said lower aperture to lower the toilet seat to the lowered position.

* * * * *